United States Patent [19]

Lestradet

[11] 4,058,260

[45] Nov. 15, 1977

[54] SELECTABLE, ANTI-LEAK, NOZZLE-HOLDER

[76] Inventor: Maurice Cyril Lestradet, 291 rue du Marechal Delattre de Tassigny, 51230 Fere Champenoise, France

[21] Appl. No.: 615,546

[22] Filed: Sept. 22, 1975

[30] Foreign Application Priority Data

Nov. 7, 1974 France ..... 74.36938

[51] Int. Cl.[2] ..... B05B 1/16

[52] U.S. Cl. ..... 239/394; 239/600

[58] Field of Search ..... 239/393, 565, 394, 533, 239/162, 117, 600, 410, 411, 412; 251/61.1

[56] References Cited

U.S. PATENT DOCUMENTS

| | | | |
|---|---|---|---|
| 1,554,521 | 9/1925 | Reece | 239/394 |
| 1,900,124 | 3/1933 | Meng | 239/267 X |
| 2,065,144 | 12/1936 | Miller et al. | 251/61.1 X |
| 2,665,710 | 1/1954 | McGarry et al. | 251/61.1 X |
| 2,732,069 | 1/1956 | Henderson | 251/61.1 X |
| 3,188,009 | 6/1965 | Miscovich | 239/394 X |
| 3,385,525 | 5/1968 | Jacobs | 239/394 |
| 3,637,142 | 1/1971 | Gassaway | 239/394 |
| 3,684,177 | 8/1972 | Barlow | 239/171 |

*Primary Examiner*—John J. Love

*Attorney, Agent, or Firm*—Wolf, Greenfield & Sacks

[57] ABSTRACT

In a device to be mounted on a vehicle for spraying, a nozzle holder having a plurality of nozzles selectively alignable with a duct carrying fluid for spraying, said nozzles being alignable by remote control means, said nozzle holder having an anti-flow device to prevent leakage when said device is not activated.

11 Claims, 3 Drawing Figures

SELECTABLE, ANTI-LEAK, NOZZLE-HOLDER

SUMMARY AND BACKGROUND OF THE INVENTION

The present invention relates to a spraying device designed to be fitted onto collapsible and non-collapsible spreaders mounted on agricultural machines such as sprayers.

Spreaders mounted on wheeled agricultural sprayers are generally composed of a feed line supplying a series of nozzles designed to spread, by spraying a liquid which may be a fertilizer, a pesticide, a fungicide, or other fluids such as insecticides. These nozzles are usually of such a type, that those appropriate for use with respect to one product or crop are inappropriate for, and therefore cannot be used with respect to another product or crop. Because of this lack of interchangeability of uses, all the nozzles must be frequently replaced and the operation by which this is done is time consuming. In addition this situation compels the operator to have available a large number of nozzles of different calibers or types requiring a substantial financial outlay and seriously complicating equipment storage.

To solve this problem it is here proposed that the well-known principle of cock valves or gate valves of the selector type be used. In this case it is sufficient to equip each arm of the valve or nozzle holder with a given type of nozzle for the product to be spread, supplied by the feed line, to be distributed by any one of the nozzles selected. This manually controlled selection, enabling dispensers of various types to be supplied with liquid at constant pressure, is also well known, for example in domestic plumbing where the selector enables a changeover to be made from the bathtub faucet to the shower spray head by a simple manual action; the dispensers, of different types, remain unchanged but are simply activated and inactivated.

The invention thus consists of applying this known principle of a selector valve in a novel manner to spreaders such that one may choose the nozzle type to be used for the type of jet desired according to the nature of the crop to be treated, without changing the nozzle in question. To facilitate selection of the type of nozzle necessary, control may advantageously be effected from the driver's seat such that the operator need not descend from the vehicle to manipulate each nozzle-holder individually.

With this concept, and according to a preferred embodiment, this spraying device for spreaders is designed to be mounted on agricultural vehicles, in particular sprayers, and is characterized by including the nozzle-holder of the present invention which is composed of an annular body with several arms, each of which is equipped with a spray nozzle, said annular body having an axial opening for receiving a plug which provided with a single axial passageway communicating with a radial duct, said duct being capable of being brought selectively opposite any one radial passageway of said annular body each of which is aligned with one of the nozzles, and said plug being supplied by a feed line.

According to one embodiment of the invention, the nozzle-holder body is able to rotate with respect to the plug, which is fixed, such that the desired nozzle type is selected by angular displacement of said annular body.

According to another embodiment of the invention, the nozzle-holder is romote-controlled from the seat of the vehicle on which the device is mounted.

One object of the present invention is to provide a nozzle holder, to be used on a vehicular mounted spraying device, which conveys a plurality of nozzles.

Another object of this invention is to provide a nozzle holder, to be used on a vehicularly mounted spraying device, which may be oriented so that different nozzles may be selected for spraying.

Still another object of the present invention is to provide a nozzle holder in which the selection of the nozzle to be used for spraying may be made by romote means.

A further object of this invention is to provide in a spraying device to be mounted on a vehicle a nozzle holder having an anti-flame device to prevent leakage of the fluid.

A spraying device constructed according to this invention is shown as a non-limitative example in the figures attached.

BRIEF FIGURE DESCRIPTION

DETAILED FIGURE DESCRIPTION

The spraying device is composed of a nozzle-holder 1 which is in the form of an annular body having several arms symmetrically distributed on the annular body which is circular in shape. In the present embodiment, the arms are four in number and are disposed symmetrically 90° apart, and each arm has nozzle 2. These nozzles can be of four different types or two different types arranged respectively in succession or in alternating pairs. For example, they may in particular use two turbulent nozzles and two slotted nozzles.

Figure 3:
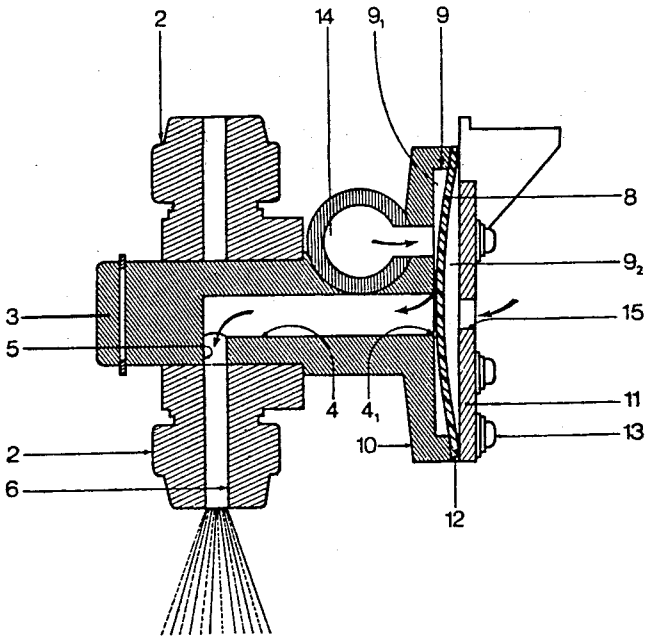
FIG. 3 is an axial section of FIG. 1.
Figure 1:
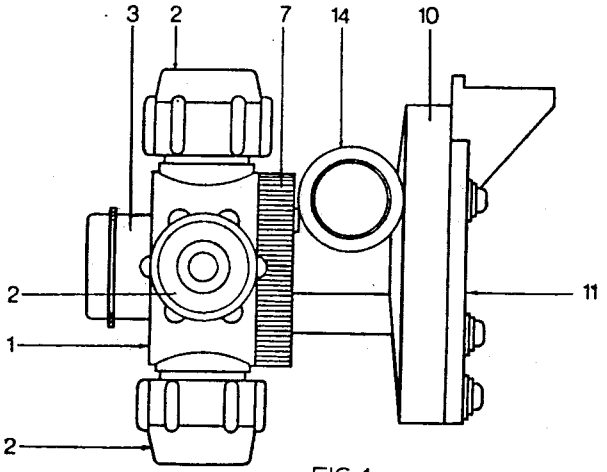
FIG. 1 is a plane view of an embodiment of this invention.
Figure 2:
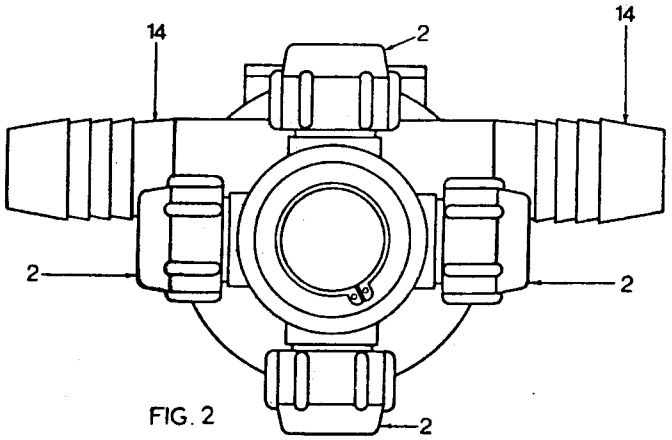
FIG. 2 is a view from the left of FIG. 1.

This nozzle holder body 1 is rotatably mounted on a fixed plug 3, which has a single axial passageway 4 communicating with a radial duct 5 which can be brought selectively opposite any one of nozzles 2, as shown in FIG. 3. Well known devices, such as ball ratchets or catches (not shown) are used to permit snap-locking of the nozzle-holder in the four positions corresponding to the alignment of radial duct 5 of the plug with duct 6 of each of the nozzles. The nozzle-holder 1 is deliberately rotatably mounted, in contradistinction to the known selector valve wherein the known selector valve wherein the channel is fixed and the plug rotatably displaceable, such that maneuvers, particularly nozzle selection, are facilitated. In addition this assemblage permits the set of nozzle-holders of the spraying device to be remote-controlled from the driver's seat. In fact, it is sufficient to interlock the nozzle-holders of the spraying device such that the operator does not have to alight to maneuver each nozzle-holder individually. This remote control can be of the pneumatic, hydraulic, mechanical, or electrical type. According to the embodiment shown in the Figures selective maneuvering of the nozzle-holders of the spreader can be achieved by an electric motor coupled to a gear 7 mounted on the nozzle-holder, said coupling being of known geared or belt type. The nozzle-holder is situated in a vertical plane such that during rotation it does not snag plant stems, which would be the case if the nozzle-holder were situated in a horizontal plane. In addition, this vertical nozzle-holder arrangement and the rotation thereof considerably simplifies the construction of the spraying device since the radial duct 5 points downward and the operating nozzle 2 is the one pointing toward the ground (FIG. 3). Hence, this direct communication between the plug and the operating nozzle substantially reduces problems of watertightness and thus enables costly devices such as check valves, springs, cams, joints, etc. to be eliminated. In addition, this very great simplification in the nozzle-holder design also eliminates assembly difficulties and facilitates servicing the device.

It is however possible, while keeping the nozzle-holders vertical, to direct radial duct 5 of the plug 3 upward such that the operating nozzle is the upward-directed nozzle, in this way "mirror" nozzles can be used.

According to a preferred embodiment, the nozzle-holder can be combined with an anti-drip device as described in French Pat. No. 71,32,554 patented by the present applicant. This device is composed of a flexible diaphragm 8 which divides a dispensing chamber 9 into two parts. This chamber is formed of a body 10 associated with the nozzle-holder, closed at its upper part by a lid 11 which compresses the peripheral edge 12 of the diaphragm, held in place by metal screws 13. Part $9_1$ of distribution chamber 9 situated downstream of diaphragm 8 is in direct communication with feed pipes 14 connected to the feed line supplying the nozzles with the product to be spread. Part $9_2$ of this same distribution chamber, situated upstream of the diaphragm, is connected to the source of fluid, penetrating via axial passageway 15. This fluid source, which may be pneumatic or hydraulic, can obviously be replaced by any other pressure means. Diaphragm 8 is situated opposite axial passageway 4 of the plug and also opposite the connecting passageway of duct 14 such that, under the force of the pressure means blown into part $9_2$ of the distribution chamber, it bears both on mouth $4_1$ of this passageway and on the connecting passageway of duct 14 such that it stoppers them tightly. Since this anti-drip device is activated only when the feed is interrupted in ducts 14, the pressure means introduced into $9_2$ of the dispensing chamber can be a low-pressure means.

The anti-drip device is situated upstream of the nozzle-holder such that diaphragm 8 prevents the remainder of the stagnant product from flowing into the feed line or feed pipes 14. Hence, a single diaphragm ensures watertightness of all the nozzles on one nozzle-holder.

With a view to simplifying the operator's task, the anti-drip devices will, of course, be controlled from the driver's seat; here again this control can be mechanical or electrical without thereby altering the invention.

In addition the diaphragm can be replaced by any other stoppering device, for example an axially displaceable piston provided with an end gasket and applied in a watertight manner either to inlet passageway $4_1$ of the axial passageway of the plug or to the connecting passageway of feed pipes 14.

The concept of this nozzle-holder and remote control thereof, both in nozzle selection and in activation or de-activation of the anti-drip devices from the driver's seat, permit operation under ideal automation conditions since the operator can adapt said spraying device to the various types of crop to be treated without getting down from his seat.

The invention is not, of course, limited to the embodiment described hereinabove, other design variations of which may be made without thereby departing from the scope of the invention.

What is claimed is:

1. A nozzle device for mounting on a vehicle comprising:

an annular body having a plurality of radial passages, a plurality of arms each being provided with a spray nozzle, means for radially interengaging said arms about the periphery of said annular body, each in alignment with a radial passage, said annular body having an axial opening to receive a plug, said plug having an axial passageway extending longitudinally between opposite ends of the plug and connecting to a radial duct at one end of the plug, said duct and annular body arranged for selective alignment of said duct with one of said radial passages, said annular body being mounted rotatably with respect to the plug whereby selection of a given nozzle type is effected by angular displacement of said annular body, said plug having at its other end an anti-drip means comprising a body at the other end of the core forming in part a dispensing chamber and a diaphragm supported across the dispensing chamber and deflectable to cover at least said axial passageway to stopper it, said plug having at its other end means defining an inlet duct integral with the plug and a port extending between the inlet duct and dispensing chamber, said inlet duct communicating with the port and extending transversely to the axial passageway in the plug, said inlet duct having opposite open ends permitting inlet feeding from the holder to an adjacent holder.

2. A device as described in claim 1 including;

means for romote control of said annular body;

said means for remote control comprising an electric motor and drive means for interconnecting said electric motor and said annular body of said nozzle holder.

3. A nozzle device as set forth in claim 1 wherein said plug comprises a somewhat elongated solid member having a cylindrical section accommodated by the annular body and wherein the body of the anti-drip means comprises an enlarged diameter other end of the plug having a channel partially defining the dispensing chamber.

4. A nozzle device as set forth in claim 3 wherein said means defining an inlet duct includes a straight pipe disposed between the enlarged diameter other end of the plug and the cylindrical section of the plug.

5. In a device to be mounted on a vehicle for spraying, a nozzle holder as described in claim 2 further characterized by, said motor having an output pinion said drive means comprising a gear mounted on said nozzle, said pinion interconnected with said gear to turn said gear.

6. In a device to be mounted on a vehicle for spraying, a nozzle holder as described in claim 2 further characterized by, said annular body being oriented so that all of said radial passages lie in a vertical plane, said radial duct being pointed downward so that the radial passage aligned with said duct is pointing downward as is the nozzle aligned with said radial passage.

7. In a device to be mounted on a vehicle for spraying, a nozzle holder as described in claim 1 further characterized by, said annular body being oriented so that all of said radial passages lie in a vertical plane, said radial duct being pointed upwardly so that the radial passage aligned with said duct is pointing upward as is the nozzle aligned with said radial passage, said arms each equipped with nozzles.

8. In a device to be mounted on a vehicle for spraying, a nozzle holder as described in claim 1 further characterized by, each of said arms being equipped with a different type of nozzle, said arms being four in number.

9. In a device to be mounted on a vehicle for spraying, a nozzle holder as described in claim 1 further characterized by, said arms being four in number, two of said arms being equipped with one type of nozzle the other two arms equipped with a different type.

10. A nozzle device as defined in claim 1 wherein said plug has a channel in its body end covered by a lid to define the dispensing chamber across which said diaphragm is secured, said lid having an aperture for permitting fluid flow to the chamber to deflect the diaphragm against the flat end wall surface.

11. A nozzle holder as defined in claim 10 wherein the port in the feed line and the axial passageway communicate with the chamber adjacent to each other but separated by a segment of the flat end wall surface.

* * * * *